US005572897A

United States Patent [19]

Aleksandrovich et al.

[11] Patent Number: 5,572,897

[45] Date of Patent: Nov. 12, 1996

[54] METHOD OF OBTAINING HOLLOW FORGINGS BY RADIAL FORGING OF SOLID BLANKS

[76] Inventors: Tjurin V. Aleksandrovich, Trofimov Str. 9/117, 112321 Moscow; Kuroles V. Ivanovich, Planernaya Str. 12/1/255, 123481 Moscow, both of Russian Federation; Lazorkin V. Andreyevich, Zadneprovskaya Str. 16a/100, 330096 Zaporozhye, Ukraine; Volodin A. Mikhaylovich, Engels Str. 41/8/18, 390010 Kurgan Ryazan, Russian Federation

[21] Appl. No.: 244,925

[22] PCT Filed: Jun. 2, 1993

[86] PCT No.: PCT/RU93/00124

§ 371 Date: Jun. 16, 1994

§ 102(e) Date: Jun. 16, 1994

[87] PCT Pub. No.: WO93/24256

PCT Pub. Date: Dec. 9, 1993

[30] Foreign Application Priority Data

Jun. 4, 1992 [RU] Russian Federation ..... 5045887/27

[51] Int. Cl.[6] ..... B21K 21/00

[52] U.S. Cl. ..... 72/368; 72/377

[58] Field of Search ..... 72/368, 374, 375, 72/376, 377; 29/526.5, 527.5

[56] References Cited

U.S. PATENT DOCUMENTS

| | | | |
|---|---|---|---|
| 3,495,428 | 2/1970 | Marcovitch | 72/91 |

FOREIGN PATENT DOCUMENTS

| | | | |
|---|---|---|---|
| 309745 | 12/1989 | Japan | 72/376 |
| 591261 | 2/1978 | U.S.S.R. | 72/377 |
| 668750 | 6/1979 | U.S.S.R. | 72/377 |
| 715195 | 2/1980 | U.S.S.R. . | |
| 1634355 | 3/1991 | U.S.S.R. . | |

OTHER PUBLICATIONS

Andritz AG, "Hydraulische Schmiedemaschine Type SMA," Graz–Andritz, Austria. A017101 2000d–84.

GFM, "Precision Forging Machines," Austria, Copyright 76–09–08/2.

GFM, "CNC–Precision Forging Machines," Austria, Copyright 1987–03–16.

Hojas, H., "Long and Continuous Forging Machines—Development and Field of Application," *Metals Technology*, Dec. 1979, pp. 449–455.

Dzugutov, M. Ya., Metallurgiya, Moscow, 1974, pp. 165–171.

*Primary Examiner*—Lowell A. Larson

*Attorney, Agent, or Firm*—Rothwell, Figg, Ernst & Kurz, P.C.

[57] ABSTRACT

Method of obtaining hollow forgings by radial forging of solid blanks where generating AA of the surface of solid blank (1) or its edge is oriented longitudinal axis CC of the working surface of forging tool (3) and blank 1 is swaged in a radial direction by at least one pair of forging tools (3) first in one direction with its subsequent rotation around longitudinal axis OO and/or is moved along axis OO, is swaged in another radial direction at defromation rates approximately within 3–8% of the current cross-sectional dimensions of blank (1) with the result that the width of the contact area element is approximately within 0.121–0.124 of said current cross-sectional dimension of blank (1).

7 Claims, 3 Drawing Sheets

METHOD OF OBTAINING HOLLOW FORGINGS BY RADIAL FORGING OF SOLID BLANKS

FIELD OF TECHNOLOGY

Figures 1, 2, 3, 4, 5, 6:
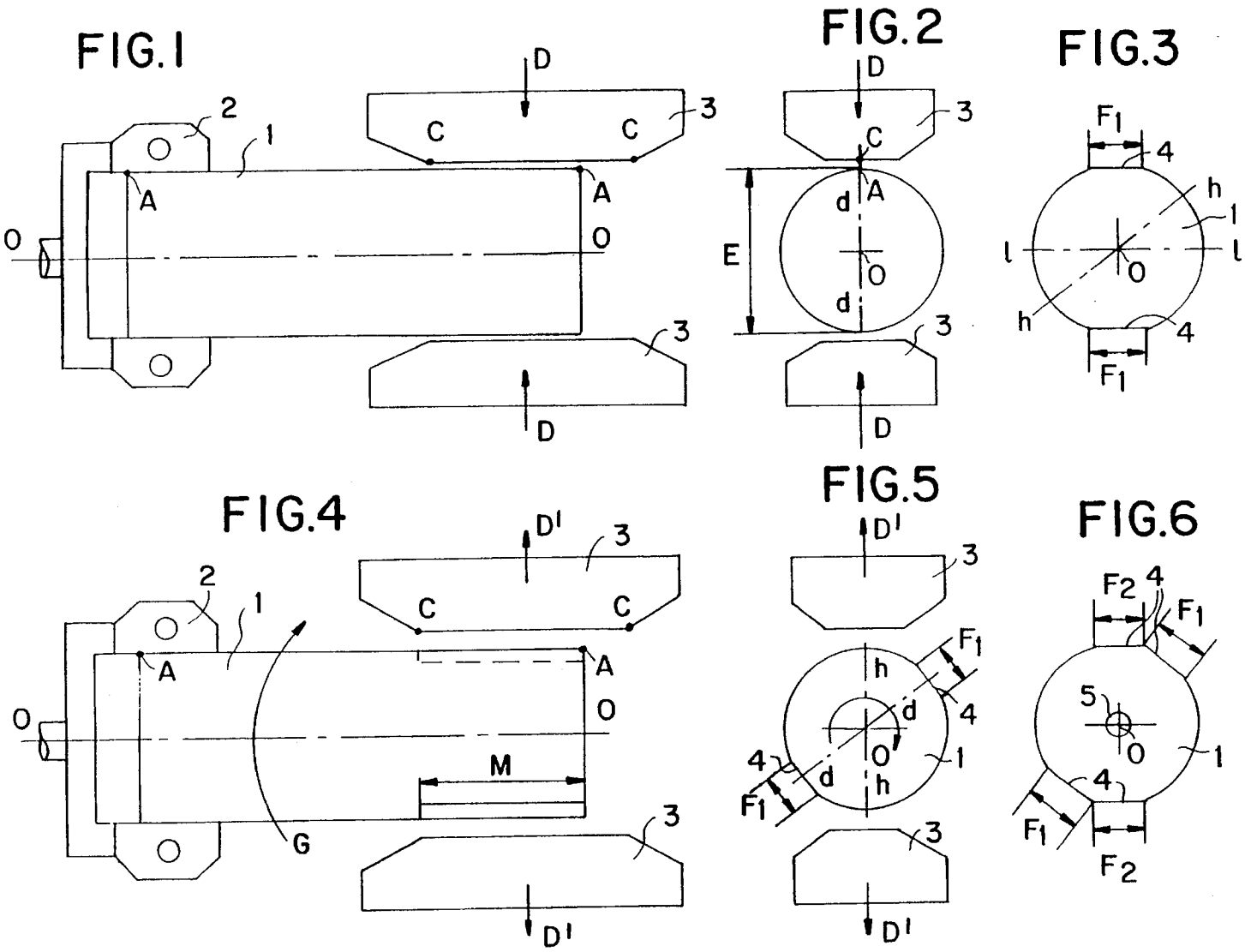

The invention pertains to the area of mechanical metalworking and deals, in particular, with a method of manufacturing hollow forgings by radial forging of solid blanks.

This method can be used in machine building and metallurgy for manufacturing long hollow intermediate products like electric motor shafts, railroad car axles, lathe tail spindles, torque transmitting spindles; also for manufacturing pipe intermediate products operating under high pressure, for instance, pipes used in assemblies of chemical and oil refining installations; as well drilling pipes, locks, nipples and so on.

PRECEDING LEVEL OF TECHNOLOGY

There is known a method of forging long solid blanks with the help of a radial forging machine (see, for instance, an advertisement leaflet of "GFM" company, Austria, "Precision forging machines". Copyright 76-09-08/2). In this method the long initial blank of round or polyhedral cross-section is heated first then set up into the chuck head of a manipulator and after that fed into the interspace of the forging tools being simultaneously rotated. The blank is swaged simultaneously through four contact surfaces from four directions at a maximum deformation rate of more than 10% with the use of four forging tools moving radially toward each other and to the blank's axis. During the intervals between swagings, when the forging tools accomplish their back travel, the blank is rotated around its longitudinal axis and moved in an axial direction with the help of manipulator. When making the next working stroke the forging tools swage other portions of the blank and so on. The above mentioned operational cycle is repeated over and over swaging the blank full length until the required sizes of the final cross-section are formed. To prevent the deconsolidation of metal in the axial zone of the blank the following forging characteristics (deformation rate and shape of forging tools) are chosen: 25.5% when the entrance angle is 15° and 20.5% when the entrance angle is 5°. The considered method of forging gives an opportunity to obtain forgings with high-precision dimensions, dense macrostructure of metal in the axial zone, with the use, to a great extent, of automation and control of deformation modes.

However, by radial forging of initial solid blank a long solid forging is obtained and that means that the above mentioned known method is not used to obtain a hollow forging. Accordingly, the solid forging should be later subjected to machining (deep drilling) to get an axial hole and so on.

In those cases when it is nevertheless necessary to obtain a long hollow product another technological process is employed: an initial long hollow blank is forged with, e.g., a mandrel in the axial blank's space (channel) (see, for instance, an advertisement leaflet of "GFM" company, Austria, "CNC-precision forging machines for mass production of rotation-symmetrical parts by hot forging or cold forging". Copyright 1987- 03-16.

In this case the initial blank is obtained by preliminarily drilling the workpiece or rolling it with the help of a Mannesmann piercing mill or by preliminary piercing with the help of hydraulic presses.

The initial hollow blank (heated or cold) is set up into the chuck head of a manipulator then a mandrel is moved into the axial channel of the blank and the rotated blank together with mandrel are fed into the interspace of the forging tools. Four forging tools moving radially toward each other and to the blank's axis simultaneously swaging the blank through four contact surfaces. During the intervals between swagings when the forging tools accomplish their back travel the blank is rotated around its longitudinal axis and moved lengthwise with the help of the manipulator. When accomplishing the next working stroke the forging tools swage other portions of the blank and so on. The above mentioned operational cycle is repeated over and over swaging the blank lengthwise to the required sizes. The considered method of obtaining hollow forgings by radial forging provides products of high precision and diversified shapes.

However, to get a long hollow product by this method it is necessary to use an initial hollow blank obtained by rolling, extrusion or machining (drilling, for example). In this case it is necessary to use expensive rolling, extrusion and machining equipment. The production of forged pieces in small batches prevents utilization of the utmost the advantages of the rolling equipment characterized by high productivity but narrow range of products sizes. The output of machining equipment for drilling holes in the initial blank is much lower than the output of forging equipment. This leads to the necessity to operate a considerable stock of expensive machine tools, to occupy substantial industrial space and spend additional capital on cutting tools. Besides, the drilling operation leads to appreciable waste of metal into chips. The price of the initial blank becomes higher, and there is a dependence on the allied production located beyond the forging shop where the radial forging machine is installed. Small batches of products and their much diversified assortment characteristic of forging production prevent use of the advantages of the rolling production that is distinctive of high output and narrow range of products sizes, as well as wide range of steel grades.

There is known another method of forging a long hollow blank with the help of a radial-forging machine (see, for instance, an article "Long and continuous forging machines, development and field of application", H. Hojas, Metals Technology, December, 1979). In this method, the initial blank of round or polyhedral cross-section is first heated then fed into the interspace of the forging tools without its rotation. The blank is swaged in the interspace of the forging tools, at maximum deformation rate of more than 10%, in turn, first with four forging tools moving simultaneously radially and to the blank's axis and then, during the back stroke of the said four forging tools, the blank is swaged, at maximum deformation rate of more than 10%, with the next four forging tools moving simultaneously radially and to the blank's axis. When the forging tools accomplish their back travel the blank is moved in the axial direction with the help of rollers. The above mentioned operational cycle is repeated over and over reducing the blank to the required sizes of the final cross-section. However, as a result of radial forging of the initial blank, according to the above described method, a long solid forging is obtained. That is to say, it is not possible to produce a hollow forging from the noted method. From this, follows all of the complications related to the subsequent drilling of long solid forgings and so on.

According to other method of forging a long solid blank with the help of a radial-swaging machine (see, for instance, an advertisement leaflet of "Andritz" company, Austria, "Hydraulische Schmiedemaschine", Type SMA, Graz-Andritz, Austria. A 017101 2000d-84) the initial blank of round or polyhedral cross-section is heated first, then is set up into the chuck head of a manipulator and fed into the interspace of the forging tools while being simultaneously rotated. Two forging tools, moving toward each other, swage the blank in a radial direction. During the intervals between the swagings, when the forging tools accomplish their back travel, the blank is rotated around its longitudinal axis and moved lengthwise with the help of the manipulator. During the next working stroke the forging tools swage other portions of the blank and so on. The above mentioned operational cycle is repeated over and over swaging the blank lengthwise to the required sizes of the final cross-section. The configuration of the forging tools for producing forgings of round cross-section is chosen in the form of radius or V-shaped. However, as a result of radial forging of the initial blank by this method a long solid forging is obtained. That is to say, it is not possible to obtained a hollow forging from the considered method.

Thus, none of the existing known methods of radial forging makes it possible to obtain long hollow forgings directly in the process of radial forging of solid blanks.

DESCRIPTION OF INVENTION

The goal of this invention is to create a method of obtaining long hollow forgings by radial forging of solid blanks.

This task is solved by a method of obtaining hollow forgings by radial forging of solid blanks, according to the invention, as follows: the generatrix of a cylindrical surface of a solid blank or the edge of a polyhedral solid blank is oriented along the longitudinal axis of the working surface of a forging tool and the blank is swaged in radial direction with the help of at least one pair of forging tools first in one direction, whereupon the blank is rotated around its longitudinal axis and or moved in the axial direction and then it is swaged in another radial direction. The deformation rate set up with every swaging is approximately within 3–8% of the current cross-sectional dimension of the blank with the result that the width of the contact surface on the blank is approximately within 0.121–0.124 of said current cross-sectional dimension of the blank.

Through the patented method one can obtain long hollow forgings in the process of radial forging of solid blanks.

It is possible after moving the blank in the axial direction to swage it first and then turn and swage again, and move back in the axial direction.

This method ensures obtaining, in the process of radial forging, a chamber in the axial zone of the solid blank only partly lengthwise. It is useful when using a simple and inexpensive manipulator.

If there are several pairs of forging tools creating the working zone, this method is expedient to make swagings of the blank with every pair of forging tools alternately.

This technique makes it possible to increase the productivity in the process of accomplishing all of the enumerated operations.

It is advisable to make the turning and/or the movement of the blank in its axial direction after alternate swagings with all pairs of forging tools.

This technique relieves the manipulator's assemblies of the load created by the torsional moments of force and reduces the rotation speed of the manipulator's clamping head.

When forging blanks of materials with high strength, for instance steel, it is expedient to heat the blank first to the forging temperature between limits 0.65 and 0.80 of the material's melting point on a Kelvin scale.

This makes it possible to reduce the required forging force and improve the operation conditions for forging tools.

It is advisable to cool the surface of the heated blank to temperature between limits 0.50–0.55 of the material's melting point on a Kelvin scale.

This technique permits intensifying the opening of the axial chamber during the process of swaging solid blanks.

Figure 7:
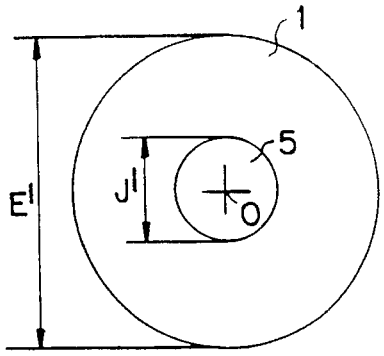
Figure 8:
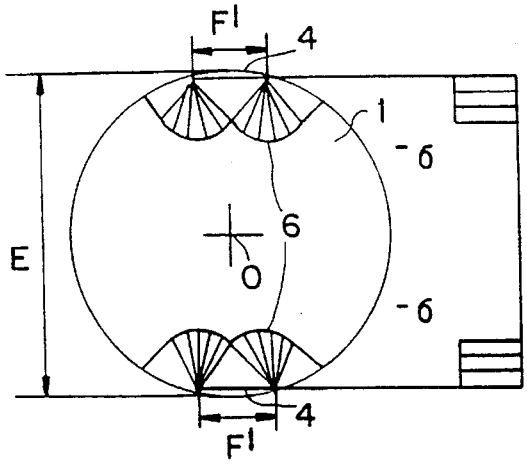
Figure 9:
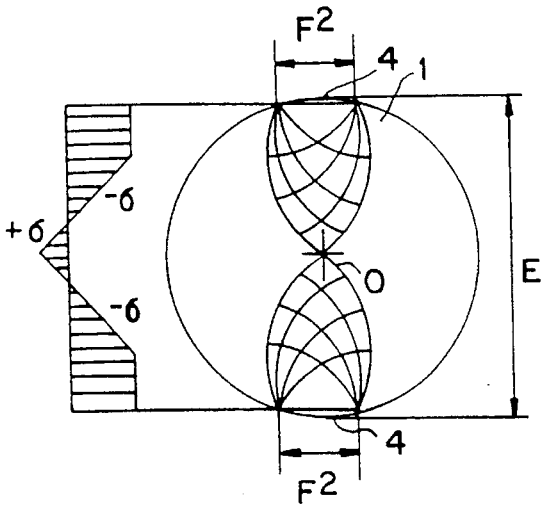
Figure 10:
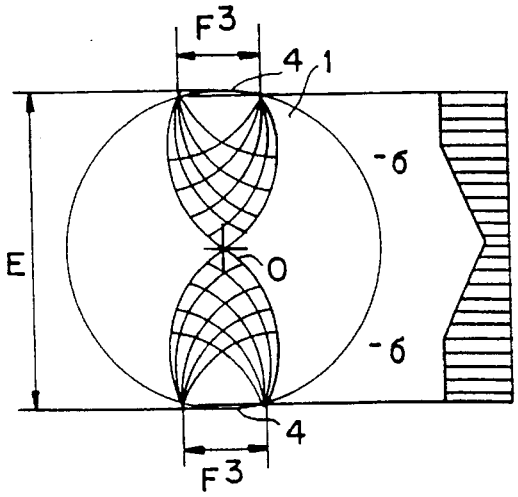
Figure 12:
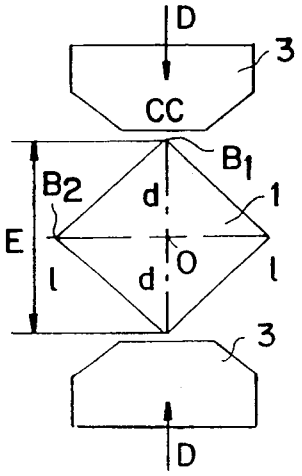
Figure 11:
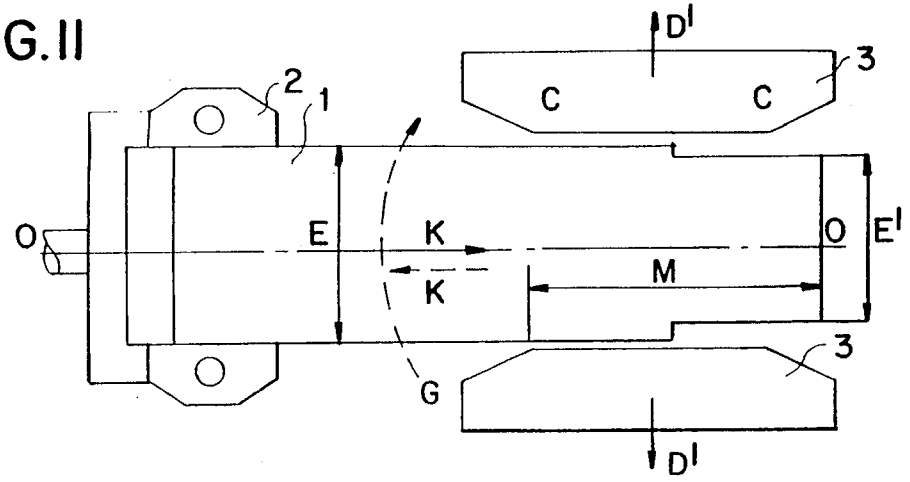
Figure 14:
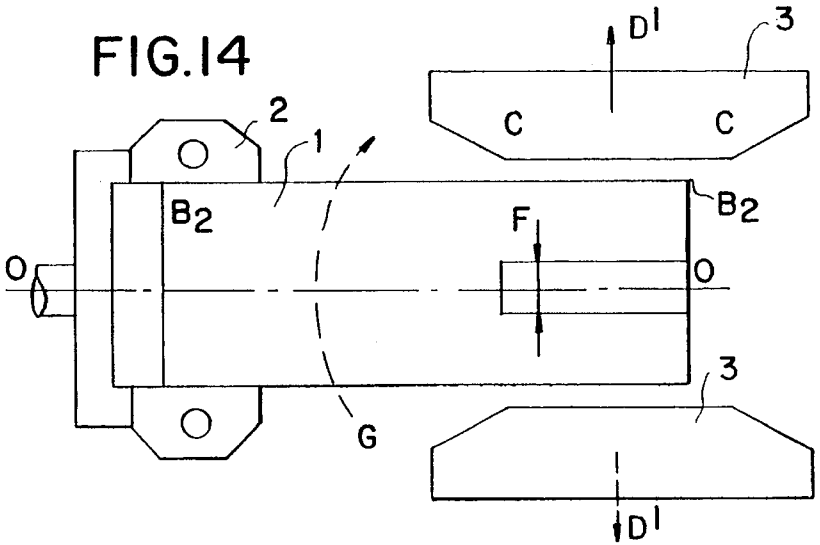
Figure 13:
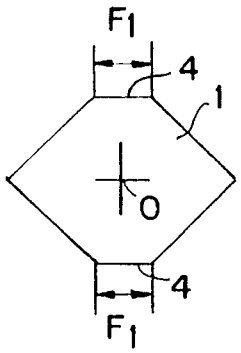

Below are given particular examples of the method being patented explaining its execution with accompanying drawings, where:

In FIG. 1 the starting position of the solid cylindrical blank in between the forging tools (side view) is schematically shown according to the invention;

In FIG. 2 the same (but end view) according to the invention;

In FIG. 3 the cross-section of the solid cylindrical blank is schematically shown after the first single swaging according to the invention;

In FIG. 4 the position of the solid cylindrical blank is schematically shown before the next swaging (side view) according to the invention;

In FIG. 5 the position of the cylindrical blank is shown before the second swaging (end view) according to the invention;

In FIG. 6 the blank is schematically shown after the second swaging with the formed chamber in blank's axial zone (end view) according to the invention;

In FIG. 7 the blank is schematically shown after having been swaged all around its periphery, as well as the axial chamber formed in the blank (end view) according to the invention;

In FIG. 8 the position of the plastic zone and normal horizontal stress distribution in the blank's cross-section are shown, when the blank is being swaged at a deformation rate of less than 3% according to the invention;

In FIG. 9 the position of the plastic zone and normal horizontal stress distribution in the blank's cross-section are shown, when the blank is being swaged at a deformation rate of more than 3% but less than 8% according to the invention;

In FIG. 10 the position of the plastic zone and normal horizontal stress distribution in the blank's cross-section are shown, when the blank is being swaged at a deformation rate of more then 8% according to the invention;

In FIG. 11 the blank's position (side view) is schematically shown after the movement in the axial direction as well as the portion of the blank's length where the axial chamber should be obtained according to the invention;

In FIG. 12 the position of a polyhedral blank and its edge are schematically shown with respect to the forging tools before the swaging according to the invention;

In FIG. 13 the position of a polyhedral blank and its edge are schematically shown with respect to the forging tools after swaging according to the invention;

In FIG. 14 the position of polyhedral blank (side view) is schematically shown after its turn around the longitudinal axis before the second swaging according to the invention;

THE BEST VERSION OF INVENTION REALIZATION

The method being patented of obtaining hollow forgings by radial forging of solid blanks is implemented in the following way.

Initial solid blank 1 (FIG. 1), for instance, of round cross-section is placed in chuck head 2 of manipulator and then fed into the working space between forging tools 3. Generatrix AA of cylindrical surface of solid blank 1 is oriented along longitudinal axis CC of the working surface of forging tool 3 and the blank is swaged in radial direction with the help of one pair of forging tools 3 first in the direction of arrow D (axis d—d, FIG. 1 and FIG. 2) at deformation rate $\epsilon$ of current cross-sectional dimension E of blank 1. As a result of swaging, there on the blank 1 appear contact area elements 4 (FIG. 3) with width $F_1$ constituting value $\theta$ ($\theta=F_1/E$) of above mentioned current cross-sectional dimension E of blank 1. When forging tools 3 accomplish their back travel in direction of arrow D' (FIG. 4) blank 1 is rotated around its longitudinal axis OO in direction of arrow G and then swaged in some other radial direction (along axis h—h, FIG. 5) at same deformation rate $\epsilon$ with the result that there on blank 1 appear new contact area elements 4 with width $F_2$, constituting value $\theta$ ($\theta=F_2/E$) of current cross-section dimension E of blank 1 while $F_1=F_2$. As this takes place, there in the axial zone of blank 1 starts opening chamber 5 (FIG. 6). The development of chamber 5 is caused by presence of acting tensile stresses in the axial zone of blank 1, exceeding the tensile strength of the blank's material.

The above mentioned operational cycle is repeated over and over swaging blank 1 all around its periphery with the result that its cross-section acquires dimension value E' (FIG. 7) and axial chamber 5 correspondingly dimension J'. Dimension E' becomes the initial value for assigning the deformation rate when the above mentioned operational cycle is going to be repeated for subsequent expansion of axial chamber 5. The described operations can be done, for instance, only at portion M (FIG. 4) of blank's 1 length where it is necessary to obtain the axial chamber.

Deformation rate $\epsilon$ is assigned within approximately 3–8% of current cross-sectional dimension E of blank 1. As a result of such swaging the width of the contact area element is within 0.121–0.124 of the above mentioned current cross-sectional dimension E of blank 1. Here, the lower limit of deformation rate $\epsilon_1=3\%$ (with the result that width $F^1$ of contact area element 4 constitutes $\theta_1=0.121E$) stems from the fact, that at lower deformation rate the plastic deformation is localized in surface zone 6 (FIG. 8) of blank 1, it does not reach the axial zone where tensile stresses G do not exceed the elastic limit of blank 1 material.

With a deformation rate $\epsilon>3\%$ the plastic deformation reaches the axial zone of blank 1 (FIG. 9), here width $F^2$ of contact area element 4 constitutes $\theta_2>0.121E$ and under this ratio of dimensions in the axial zone of blank 1 there act tensile stresses $\sigma$ exceeding the tensile strength of the material of blank 1 and leading to the metal's deconsolidation.

The upper limit of deformation rate $\epsilon_3=8\%$ (with the result that width $F^3$ (FIG. 10) of contact area element 4 constitutes $\theta_3=0.124E$) stems from the fact that although the plastic deformation reaches the axial zone, however, under this ratio of dimensions tensile stresses $\sigma$ do not exist in the axial zone of blank 1 and the metal's deconsolidation doesn't take place.

During forging blank 1 when contact area elements of width F are more then 0.121E and less than 0.124E, tearing of the internal layers of blank's 1 material takes place as well as increasing the axial chamber while maintaining the continuity of the rest of blank's 1 thickness.

When forging tools 3 (FIG. 11) accomplish their back travel in direction of arrow D' blank 1 can be moved along axis OO in direction of arrow K and then swaged in some other radial direction (along axis 1—1, FIG. 3). The mentioned operations are repeated over and over. After having made swagings at portion M of blank's 1 length, where it is desired to obtain the axial chamber, the blank is turned around its longitudinal axis OO in direction of arrow G and the above mentioned operational cycle is repeated again.

When forging tools 3 accomplish their back travel in direction of arrow D' (FIG. 4) blank 1 can be rotated around its longitudinal axis OO in direction of arrow G and moved along axis in direction of arrow K (FIG. 11) and then swaged in some other radial direction (along axis h—h, FIG. 5, or along axis 1—1, FIG. 3).

The mentioned operations are repeated swaging blank 1 all around its periphery.

Initial solid blank 1 can be a polyhedron in its cross-section, for instance, a square (FIG. 12).

In this case edge $B_1B_1$ (FIG. 12) of polyhedral blank 1 is oriented along longitudinal axis CC of the working surface of forging tool 3 and swaged in radial direction with a pair of forging tools 3 in direction of arrow D at a deformation rate of current cross-sectional dimension E of blank 1. As a result of swaging (FIG. 14) contact area elements 4 appear on blank 1 with width F constituting value $\theta$ ($0.121<\theta<0.124$) of above mentioned current cross-sectional dimension E of blank 1 (FIG. 13).

When forging tools 3 accomplish their back travel in direction of arrow D' (FIG. 14) blank 1 can be rotated around its longitudinal axis OO in direction of arrow G and oriented by its adjacent edge $B_2B_2$ unswaged during the preceding stroke of forging tools (FIG. 12 and FIG. 14), along longitudinal axis CC of the working surface of forging tool 3 and then swaged in some other radial direction (along axis 1—1, see FIG. 12) at deformation rate $\epsilon$ with the result that there on blank 1 appear new contact area elements with width $F_2$, constituting value $\theta$ ($0.121<\theta<0.124$) of cross-section dimension E of blank 1. As this take place, chamber 5 starts opening in the axial zone of blank 1 (for the case of the polyhedral blank the chamber is not illustrated).

The above mentioned operational cycle is repeated over and over swaging blank 1 all around its periphery with the result that its cross-section acquires dimension E' and axial chamber 5 correspondingly dimension J'.

Although the claimed method is described by the example of forging a blank of square cross-section it is obvious that the same sequence of operations is used in forging initial blanks of cross-section with more edges and the same result of obtaining an axial chamber in a blank is achieved.

When forging tools 3 accomplish their back travel in direction of arrow D' blank 1 can be moved along axis 00 in direction of arrow K (FIG. 11) and then swaged in some other radial direction (along axis 1—1, FIG. 12). The above mentioned operational cycle is repeated over and over.

After having made swagings at portion M (FIG. 11) of blank's 1 length, where it is desired to obtain the axial chamber, the blank can be rotated around its longitudinal axis OO in direction of arrow G and oriented by its adjacent edge $B_2B_2$, unswaged during the preceding forging pass, (FIG. 12 and FIG. 13) along longitudinal axis CC of the working surface of forging tool 3 (FIG. 14) and the indicated operational cycle can be repeated again.

When forging tools 3 accomplish their back travel in direction of arrow D' blank 1 can be rotated around its longitudinal axis OO in direction of arrow G, oriented by its adjacent edge $B_2B_2$, unswaged during the preceding stroke of forging tools, along longitudinal axis OO of the working surface of forging tool 3 and moved along axis OO in direction of arrow K (see FIG. 11) and the swaged in some other radial direction (along axis 1—1, FIG. 12).

According to the method being patented it is also possible to move blank 1 along axis OO in direction of arrow K (FIG. 11), then rotate it around its longitudinal axis OO in direction of arrow G, swage once more and move it again along axis OO in back direction. It is expedient to use such an operational cycle when inexpensive and simple manipulators are used.

When several pairs of forging tools 3 are available it is expedient to swage blank 1 with every pair of forging tools 3 in turn. This technique makes it possible to raise the production output and at the same time to accomplish all mentioned operational cycles over blank 1.

When forging blank 1 with several pairs of forging tools 3 it is possible to rotate the blank around its longitudinal axis OO in direction of arrow G and/or move it along axis OO in direction of arrow K after accomplishing alternate swagings with all available pairs of forging tools 3. This technique relieves the manipulator's assemblies of the load created by the torsional moments of force and reduces the rotation speed of its clamping head.

When processing long hollow blanks by the method being patented it is possible to accomplish the following operational cycle (moving blank 1 along axis OO, swaging, rotating it around its longitudinal axis OO, next swaging and next moving it along axis OO) in parts from the initial swaging portion to the whole blank's 1 length. This technique makes it possible to obtain an axial chamber not in full forging's length but only along that portion of its length where it is desired to obtain the chamber.

When forging blanks of materials with high strength, for instance of steel, it is expedient to heat the blank 1 first to the forging temperature range. For different ferrous alloys this temperature range is approximately from 0.65 to 0.80 of the melting point for blank's material on Kelvin scale. The blank's shouldn't be overheated, nor underheated as well, because of greater resistance of blank's material to deformation.

When forging a hot blank it is possible to cool its surface just before swaging to the temperature approximately from 0.5 to 0.55 of the melting point for blank's material on Kelvin scale. This technique permits intensifying the opening of the axial chamber during the process of swaging solid blanks. There is little point in substantially cooling the blank to a lower temperature because of possible deterioration of the plasticity of the blank's material, nor in slightly cooling the blank because of little difference in the material's strength characteristics between surface and axial zones of the blank.

EXAMPLE 1

A cylindrical solid steel blank of E=80 mm in diameter and with content of 0.45% C. was heated to 1220 C., set up in the chuck head of a manipulator of a standard radial-forging machine, fed into working space between flat forging tools and swaged 4 mm down (a deformation rate $\epsilon$=5%). As a result, there on the surface of the blank appeared two flat contact area elements with width F=9.8 mm each ($\theta$=F/E=0.123). Rotating the blank around its longitudinal axis after every swaging the operational cycle was accomplished with the blank swaged all around its cross-section periphery. Thus, a polyhedral forging was obtained with final size of cross-section in 76 mm (measured between two opposite flat parts of the cross-section) as well as a chamber in the axial zone of the swaged portion (12 mm in mean diameter).

EXAMPLE 2

A similar cylindrical hot blank was fed into the working space of the forging tools and swaged 2 mm down (a deformation rate $\epsilon$=2.5%). As a result, there on the surface of the blank appeared two flat contact area elements with width F=9.6 mm each ($\theta$=F/E=0.120). The swaging process was repeated with the blank being rotated around its longitudinal axis after every swaging. The operational cycle was finished with the blank swaged all around its cross-section periphery. Thus, a polyhedral forging was obtained with final size of cross-section in 77.6 mm (measured between two opposite flat parts of the cross-section). The continuity of blank's material in the axial zone was preserved, that is, there were no holes.

EXAMPLE 3

A similar cylindrical blank, heated to the same temperature as in the previous case, was fed into the working space of flat forging tools and swaged 7.2 mm down (a deformation rate $\theta$=9%). As a result, there on the surface of the blank appeared two flat contact area elements with width F=10.0 mm each ($\theta$=F/E=0.125). Rotating the blank around its longitudinal axis after every swaging the operational cycle was accomplished with the blank swaged all around its cross-section periphery. In this way a polyhedral forging was obtained with final size of cross-section in 72.8 mm (measured between two opposite flat parts of the cross-section). The continuity of blank's material in the axial zone was preserved, that is, there were no holes.

Thus, the claimed method of obtaining hollow forgings by radial forging of solid blanks makes it possible to obtain long hollow forgings only at deformation rate 8%>$\epsilon$>3% and, as a result, the width of the contact area element is within 0.121–0.124 of the current cross-sectional dimension of the blank. Therewith it is possible for the first time to obtain an axial channel both along blank's full length and along some part of it, as well as a blind axial chamber without outlets to either end of the forging.

The usage of the claimed method of obtaining hollow forgings by radial forging of solid blanks makes it possible to eliminate deep drilling of forgings that is used nowadays in production of long hollow products. As a result of that there is no need to have an additional shop of precision machine tools and keep skilled labor. Besides, the utilization of the claimed method makes it possible to save up to 60–80% of metal wasted into chips by eliminating the time-consuming process of deep drilling.

INDUSTRIAL APPLICABILITY

The claimed method of obtaining hollow forgings guarantees a substantial expansion of assortment of products obtained by radial-forging.

It is quite obvious that obtaining hollow forgings by radial forging of solid blanks is cheaper than using intermediate hollow blanks received, for instance, by rolling and piercing.

In addition to the increase in production rate the new method in comparison with machining (deep drilling of solid intermediate blanks) has another advantage, namely, high quality deformation of the cast metal structure through the forging's wall. As a result, it improves substantially the mechanical properties of products. For instance, it is possible to reach approximate parity of values for metal toughness in longitudinal and transversal directions of the product what is impossible to do with the help of other known methods: neither by drilling solid forgings, nor by mandrel-forging of previously drilled blanks.

We claim:

1. A method of obtaining hollow forgings by radial forging of solid blanks including the steps of:

interposing a solid blank longitudinally between working surfaces of at least one set of forging tools;

said forging tools swaging said blank in a radial direction to form contact areas on the blank;

rotating said blank around its longitudinal axis;

said forging tools again swaging said blank in a radial direction to form additional contact areas on the blank;

each swaging of the blank by said forging tools having a fixed deformation rate of 3–8% of the initial cross-sectional dimension of said blank with the resulting widths of said contact areas being approximately within 0.121–0.124 of said initial cross-sectional dimension.

2. A method of obtaining hollow forgings by radial forgings of solid blanks including the steps of:

interposing a solid blank longitudinally between working surfaces of at least one set of forging tools;

said forging tools swaging said blank in a radial direction to form contact areas on the blank;

moving the blank in an axial direction;

said forging tools again swaging said blank in a radial direction to form additional contact areas on the blank;

each swaging of the blank by said forging tools having a fixed deformation rate of 3–8% of the initial cross-sectional dimension of said blank with the resulting widths of said contact areas being approximately within 0.121–0.124 of said initial cross-sectional dimension.

3. A method according to claim 2 including the step wherein the blank, after being moved in an axial direction and then swaged in a radial direction, is rotated around its longitudinal axis, swaged by said forging tools in a radial direction and moved back in the opposite axial direction.

4. A method according to claim 1 or claim 8 wherein the swaging is accomplished by more than one pair of forging tools.

5. A method according to claim 4 wherein the pairs of forging tools operate to alternatively swage the blank.

6. A method according to claim 1 or claim 8 wherein, prior to forging, the blank is heated to a temperature in the range of 0.65–0.80 of the melting point, on a Kelvin scale, for the material from which the blank is made.

7. A method according to claim 6 wherein after the blank is heated, and prior to forging, the surface of the blank is cooled to a temperature in the range of approximately 0.50–0.55 of the melting point, on a Kelvin scale, for the material from which the blank is made.

* * * * *